US007055529B2

(12) United States Patent
Muraki et al.

(10) Patent No.: US 7,055,529 B2
(45) Date of Patent: Jun. 6, 2006

(54) METHOD AND APPARATUS FOR CURLING EYELASHES IN SEVERAL BUNCHES

(75) Inventors: Kenichi Muraki, Hikone (JP); Naoki Yamaguchi, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 340 days.

(21) Appl. No.: 10/291,771

(22) Filed: Nov. 12, 2002

(65) Prior Publication Data

US 2003/0102005 A1 Jun. 5, 2003

(30) Foreign Application Priority Data

Nov. 9, 2001 (JP) ..... 2001-345009

(51) Int. Cl.
*A45D 2/48* (2006.01)

(52) U.S. Cl. ..... 132/217

(58) Field of Classification Search ..... 132/217, 132/216, 218; 219/222
See application file for complete search history.

(56) References Cited

U.S. PATENT DOCUMENTS 1,527,964 A * 2/1925 Patino ..... 132/217
1,542,014 A * 6/1925 Stickel ..... 132/217
1,925,266 A * 9/1933 Manning ..... 132/217
2,635,611 A * 4/1953 Marcellus ..... 132/217
2,675,004 A * 4/1954 Bablon ..... 132/120
2,684,679 A * 7/1954 Kislig ..... 132/217
3,339,561 A * 9/1967 Brickner ..... 132/217
3,838,699 A * 10/1974 Skandalakis ..... 132/217
5,007,442 A * 4/1991 Hirzel ..... 132/218
5,086,793 A * 2/1992 Kingsford ..... 132/218
6,662,809 B1 * 12/2003 Yamaguchi et al. ..... 132/217

FOREIGN PATENT DOCUMENTS

JP 2000-175724 6/2000
JP 2000-175725 6/2000
JP 2001-299431 10/2001

* cited by examiner

*Primary Examiner*—John J. Wilson
*Assistant Examiner*—Robyn Doan
(74) *Attorney, Agent, or Firm*—Oblon, Spivak, McClelland, Maier & Neustadt, P.C.

(57) ABSTRACT

A method and device for curling eyelashes in several bunches includes a positioning frame, a pressing frame mounted opposing the positioning frame and configured to move relative to the positioning frame, the pressing frame having an elastic surface, and an operating handle configured to move the elastic surface of the pressing frame in and out of contact with the positioning frame and to thereby curl eyelashes positioned between the positioning frame and elastic surface. A combing member divides the eyelashes into multiple bunches prior to curling the eyelashes. The pressing frame may be configured to curl a lash line region or a middle region of the eyelashes, or an auxiliary pressing frame can be included so that the device curls both the lash line and middle region of the lashes.

35 Claims, 12 Drawing Sheets

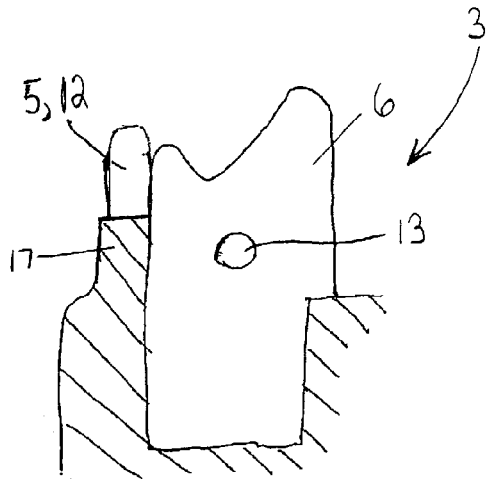
5A
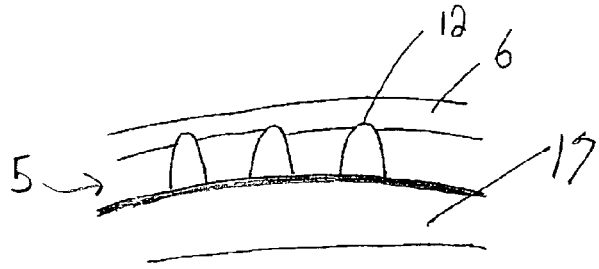
5B
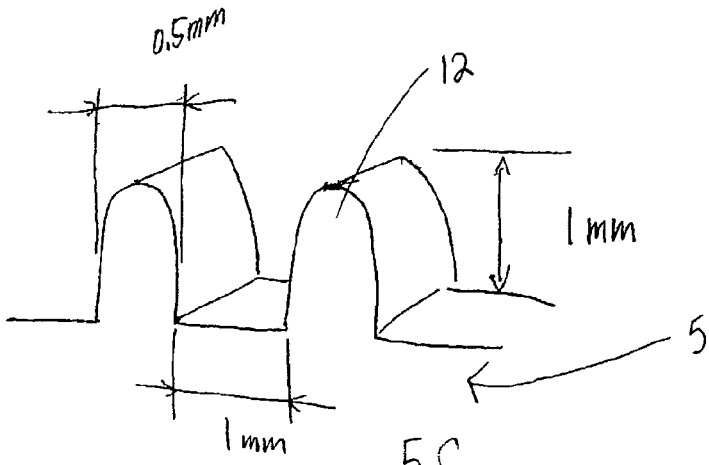
5C
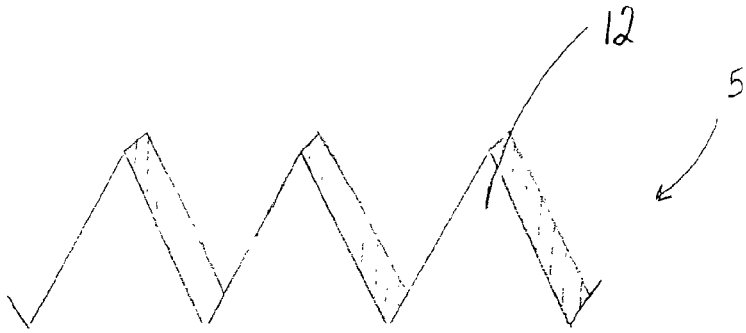
5D

METHOD AND APPARATUS FOR CURLING EYELASHES IN SEVERAL BUNCHES

BACKGROUND OF THE INVENTION

1. Field of the Invention

The present invention relates generally to eyelash curlers, and more particularly to a method and apparatus for curling eyelashes in several bunches.

2. Discussion of the Background

It is well known that curled eyelashes make the eye and eye region look more beautiful than natural uncurled eyelashes. Therefore, eyelash curling devices have been developed to curl eyelashes to a greater curvature than the natural curvature of the eyelash. These conventional eyelash curlers generally include a positioning frame for holding one side of the lashes, and a pressing frame that moves to press the eyelashes as a group against the positioning frame thereby causing curling of the lashes. While this conventional eyelash curler provides a curl to the eyelashes, the curl may be provided only near the end portion of the eyelash in a direction away from the eye. However, the present inventors have realized that curling of the eyelash near the lash line, where the root portion of the eyelash attaches to the lid, provides a more beautiful look for the eyelash.

The present inventors have also recognized that curling of the eyelashes becomes more effective if the eyelashes are curled in several small bunches rather than being curled in their natural state of relatively few large bunches. Indeed, users of conventional eyelash curlers may first comb the eyelashes to divide them into several small bunches before using the eyelash curler to actually curl the eyelashes. While this technique makes the eye and tails of the eye look more beautiful, this two-step process is difficult and time consuming. Moreover, even if the eyelashes are first combed, the conventional eyelash curler may re-bunch the eyelashes into a larger bunch when the eyelashes are pressed between the positioning frame and the pressing frame. Of course, this re-bunching reduces the effect of the combing and results in a less effective curl to the eyelash.

SUMMARY OF THE INVENTION

Accordingly, one object of the present invention is to provide a method and device for curling eyelashes, which mitigates any or all of the above described problems with conventional curling methods and or devices.

Another object of the present invention is to provide a method and apparatus for easily curling eyelashes is several small bunches rather than in the natural state of relatively few large bunches.

Yet another object of the present invention is to provide a method and apparatus for curling eyelashes in several small bunches while curling a root portion of the eyelashes.

Still another object of the present invention is to provide a method and apparatus for curling eyelashes in several small bunches while reducing the amount of re-bunching that occurs to the small bunches when the eyelash is pressed into a curvature.

These and other objects of the present invention are provided by a method and apparatus for curling eyelashes in several bunches. In one aspect of the invention a device for curling eyelashes is provided. The device includes a positioning frame, a pressing frame mounted opposing the positioning frame and configured to move relative to the positioning frame, the pressing frame having an elastic surface, and an operating handle configured to move the elastic surface of the pressing frame in and out of contact with the positioning frame and to thereby curl eyelashes positioned between the positioning frame and elastic surface. Also recited is a combing member configured to divide the eyelashes into multiple bunches prior to curling the eyelashes.

The pressing frame may be configured to curl a lash line region or a middle region of the eyelashes, or to curl both the lash line and middle region of the lashes. Where the curling device is configured to curl both the lash line and middle region of the lashes, the device includes the pressing frame and an auxiliary pressing frame. At least one of the pressing frame and auxiliary pressing frame may include a rigid part having a box shaped recess and an elastic pressing member retained within the box shaped recess and having the elastic surface. The combing member may be mounted on the rigid part or the elastic surface. In addition, the device may include another combing member mounted on either the elastic surface or rigid part of the auxiliary positioning frame.

The positioning frame may include at least one convex surface that mates with a concave surface of the pressing or auxiliary pressing frame causing curling of the eyelash along the mating surfaces. Moreover, the combing member may include a plurality of juts positioned along the combing member. The plurality of juts can be positioned parallel to one another on the combing member, or parallel to radial lines extending outward from a center point corresponding to a center point of an eyeball of a user of the eyelash curler. Each individual jut can have a contoured or sawtooth surface, and at least on of the positioning frame and the pressing frame can include a heating unit made of Nichrome wire.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 5A–5D show the details of the combing member and juts in relation to the pressing frame, in accordance with an embodiment of the present invention;

DESCRIPTION OF THE PREFERRED EMBODIMENTS

Figure 1C:
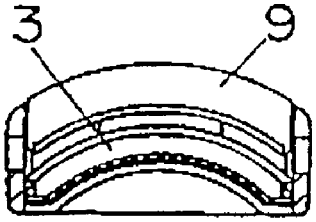
FIGS. 1A, 1B and 1C show an entire view of an eyelash curler in accordance with one embodiment of the present invention.
Figure 1A:
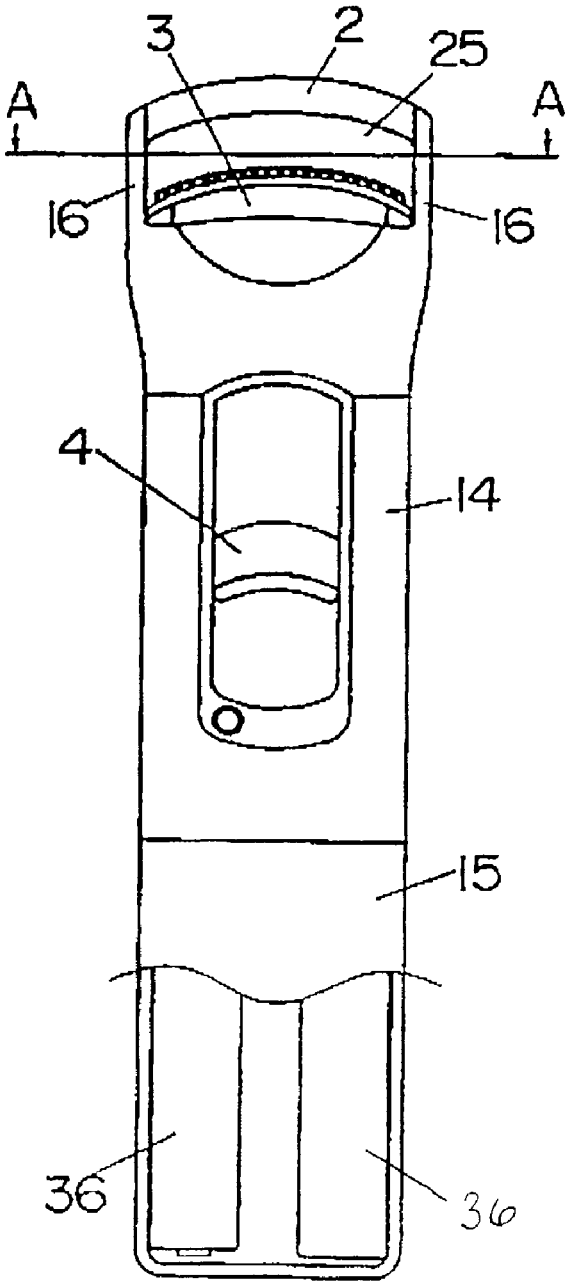
Figure 1B:
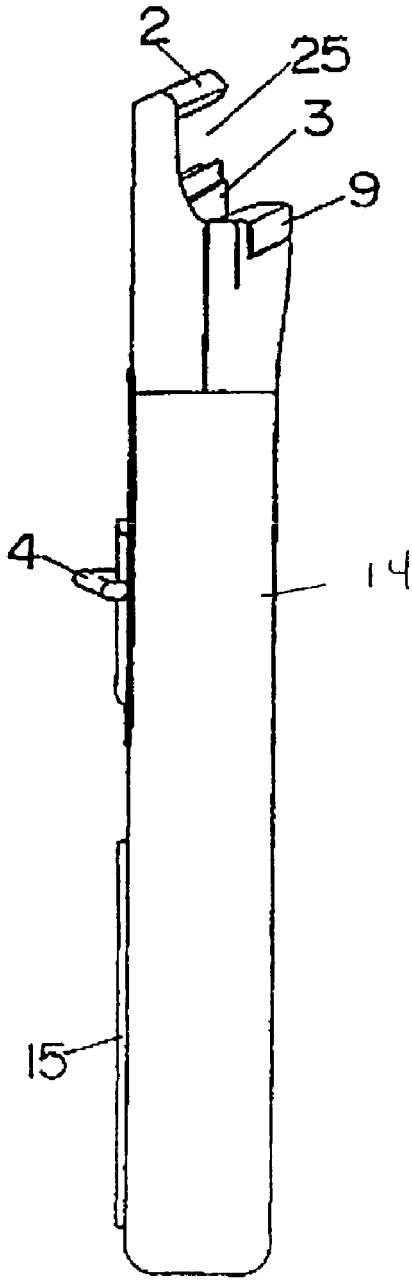

Referring now to the drawings, wherein like reference numerals designate identical or corresponding parts throughout the several views, FIGS. 1A, 1B and 1C show an entire view of an eyelash curler in accordance with one embodiment of the present invention. FIGS. 1A and 1B show a front and side view of the eyelash curler respectively, while FIG. 1C shows a top view of the eyelash curler taken along the cross section line AA in FIG. 1A. As seen in these figures, the eyelash curler includes a curler body 14 that substantially forms a handle portion of the curler, and support column sections 16 that define the curling portion of the eyelash curler. Slidably engaged to the curler body 14 is an operating handle 4, which slides up and down to operate the curling action for the eyelash curler. As seen in FIG. 1A, batteries 36 are contained within the curler body 14 by the battery cover 15, which is removable to facilitate replacement of the batteries 36. Batteries 36 provide heating power for the eyelash curler as will be further described below.

As best seen in FIG. 1A, the curling portion of the eyelash curler includes a positioning frame 2 bridging the support columns 16 and having a pressing frame 3 opposed thereto to form a window region 25 bound by the support columns 16, positioning frame 2 and pressing frame 3. As seen in FIGS. 1B and 1C, an auxiliary pressing frame 9 also opposes the positioning frame 2 and is offset from the pressing frame 3 so as not to obstruct the window region 25. The window region 25 is configured to allow eyelashes to be inserted therein for curling. Therefore, as seen in the top view of FIG. 1C, the positioning frame 2, the pressing frame 3 and the auxiliary pressing frame 9 are preferably curved to the approximate curvature of an eye or lash line where the lashes connect to the eye lid. Sliding of the operating handle 4 causes the pressing frame 3 and auxiliary pressing frame 9 to move toward and contact the positioning frame 2 to cause curling of eyelashes placed in the window 25 as will be further described below.

Figure 2A:
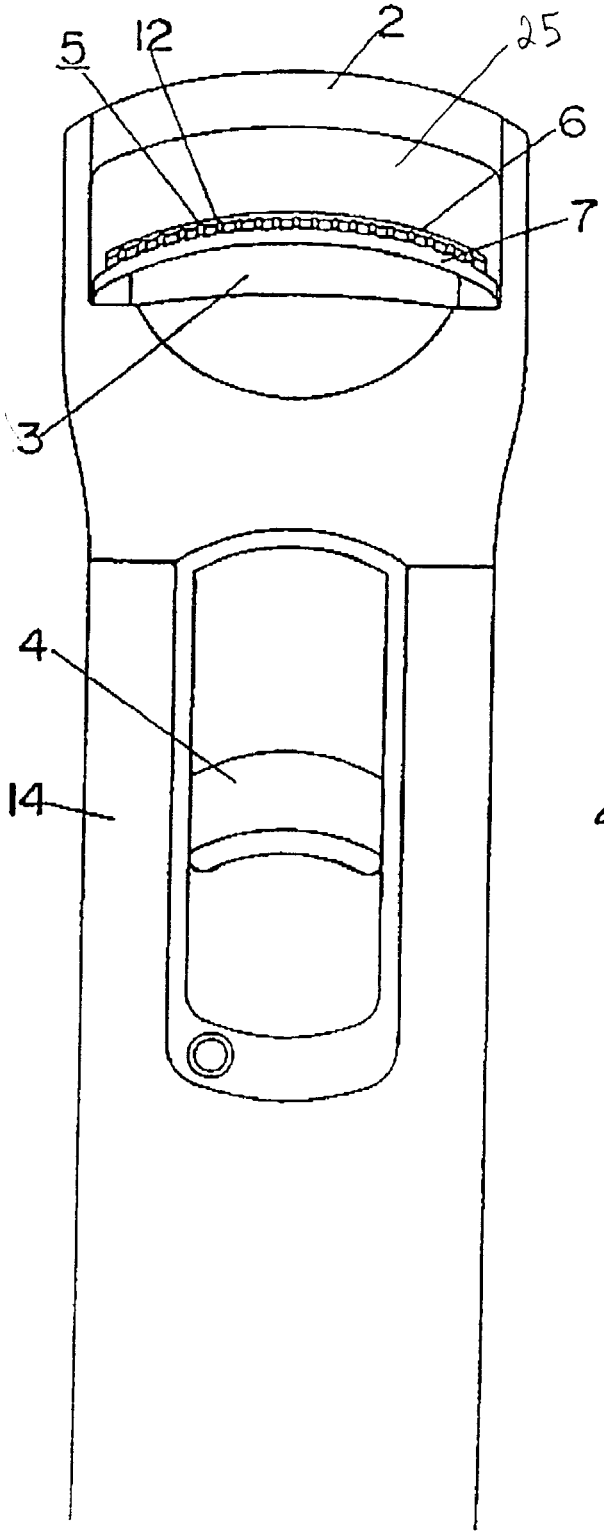
FIGS. 2A and 2B show a front view and a side cross sectional detailed view respectively of a portion of an eyelash curler in an initial position in accordance with an embodiment of the present invention.
Figure 2B:
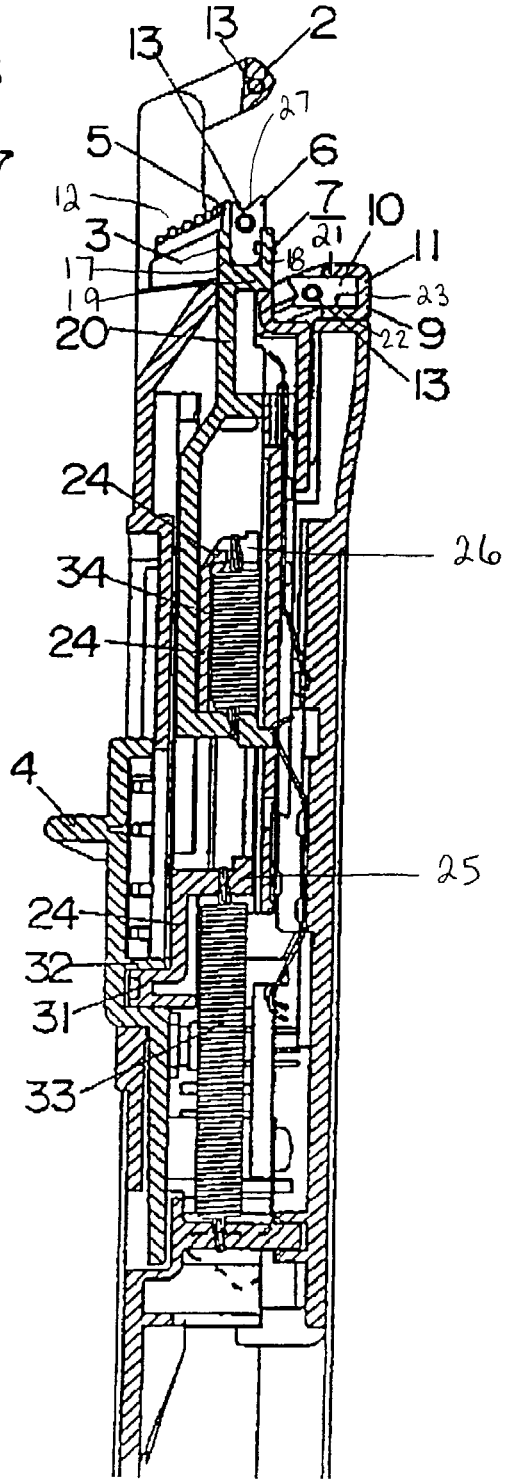

FIGS. 2A and 2B show a front view and a side cross sectional detailed view respectively of a portion of an eyelash curler in an initial position in accordance with an embodiment of the present invention. The front of the eyelash curler is the side facing the eye when the lashes are inserted into the eyelash curler. As seen in FIG. 2A, the initial position of the curler provides a window 25 for inserting eyelashes into for subsequent curling. As best seen in FIG. 2B, the positioning frame 2 includes a convex surface facing downward and a convex surface facing rearward, which are configured to abut surfaces of the pressing frame 3 and auxiliary pressing frame 9 respectively as will be further described below. The positioning frame 2, the pressing frame 3 and the auxiliary pressing frame 9 are preferably curved to the approximate curvature of tan eye or lash line of the eye.

The pressing frame 3 includes an elastic pressing member 6 contained within a box shaped part 7. The elastic pressing member 6 includes a concave, or "V" shaped, portion 27 configured to contour the downward facing convex portion on the positioning frame 2. The box shaped part 7 includes a front panel 17, back panel 18 and a bottom plate 19 joining the front and back panels to form a box shaped recess for containing the elastic pressing member 6. Attached to the front panel 17 of the box shaped part 7 is a combing member 5, which includes a plurality of juts 12 periodically spaced along the combing member 5 as shown in FIG. 2A. Thus, as with the pressing frame 3, the comb member 5 is curved to the approximate curvature of the eye. The box shaped part 7 is connected to a movable piece 20, which extends downward into the curler body 14 of the eyelash curler.

The auxiliary pressing frame 9 includes an elastic pressing member 10 contained within a box shaped part 11. The elastic pressing member 10 includes a concave, or "V" shaped, portion 29 (shown in FIG. 4) configured to contour the rearward facing convex portion on the positioning frame 2. In addition, the box shaped part 11 includes a ceiling plate 21, a bottom plate 22 and a back plate 23 joining the ceiling and bottom plates to form a box shaped recess for containing the elastic pressing member 10. The box shaped part 11 is connected to a slide knob 23, which extends downward into the curler body 14 of the eyelash curler. The details of the box shaped parts 7 and 11, as well as the elastic pressing members 6 and 10 are shown more clearly in FIG. 4, which will be described below.

As seen in FIG. 2B, in a preferred embodiment of the eyelash curler, a heating unit 13 is contained within each of the positioning frame 2, elastic pressing member 6 of the pressing frame 3, and elastic pressing member 10 of the auxiliary pressing frame 9. Alternatively, the heating unit 13 may be provided in any one or more of the positioning frame 2, elastic pressing member 6 of the pressing frame 3, and elastic pressing member 10 of the auxiliary pressing frame 9. Each heating unit 13 is preferably a coiled Nichrome wire that is electrically connected to batteries 36, which supply heating current to the Nichrome wires. In a preferred embodiment, the operating handle 4 acts as an electrical switch for supplying the heating current from the batteries to the heating units 13 when the operating handle is slid upward into a curling position. However, alternate switching devices and heating configurations may be used.

The curler body 14 contains the moving components that allow operation of the eyelash curler by movement of the operating handle 4 in an up and down direction. As noted above, the slide knob 24 is connected to the box shaped part 11 of the auxiliary pressing frame 9 and is freely movable in an up and down direction within the curler body 14. In addition, as seen in FIG. 2B, the slide knob 24 is coupled to the operating handle 4 by way of the catching part 31 of the slide knob 24 engaging the caught part 32 of the operating handle 4. Thus, the slide knob 24 moves in an up and down direction along with the operating handle 4. The slide knob 24 includes a lower hanger 25 mechanically coupled to the top end of a first spring 33, and an upper hanger 25 mechanically coupled to the top end of a second spring 34. As seen in FIG. 2B, the lower end of the first spring 33 is mechanically coupled to a portion of the curler body 14, while the lower end of the second spring is coupled to the movable piece 20, which is attached to the box shaped part 7 of the pressing frame 3.

Figure 3A:
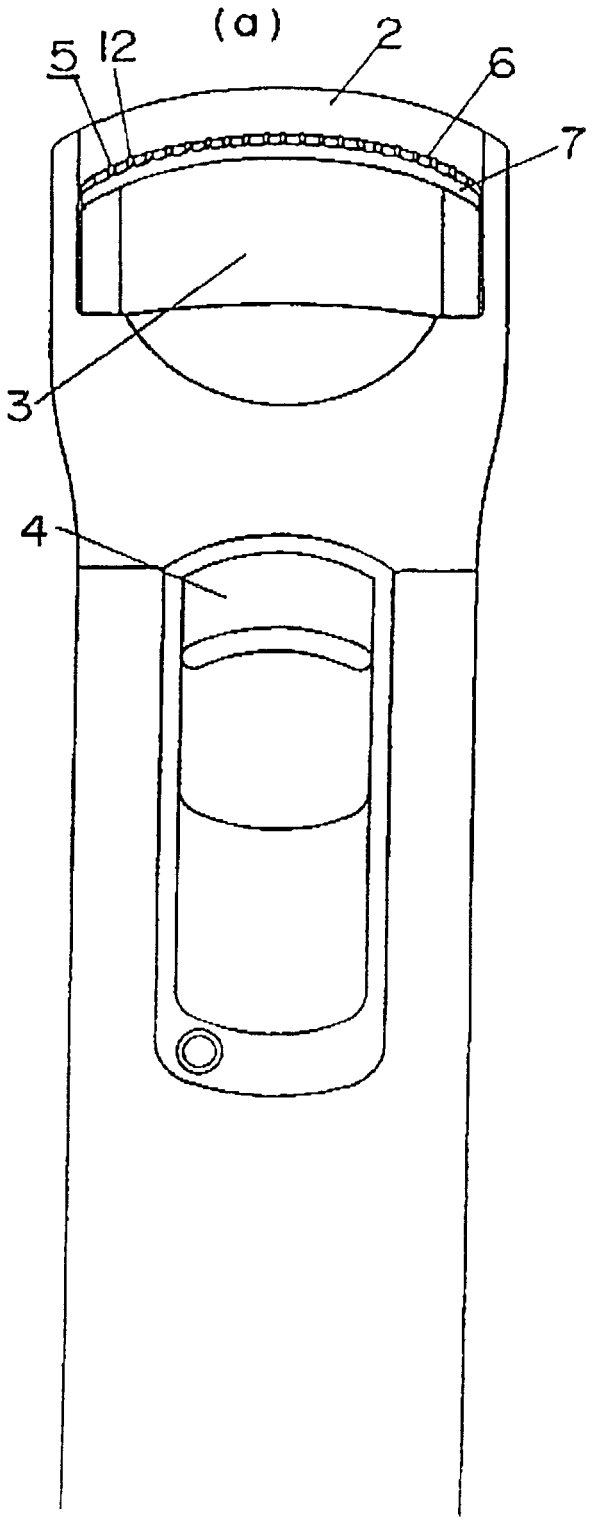
FIGS. 3A and 3B show a front view and a side cross sectional view respectively of the eyelash curler in a curling position after operation of the operating handle in accordance with an embodiment of the present invention.
Figure 3B:
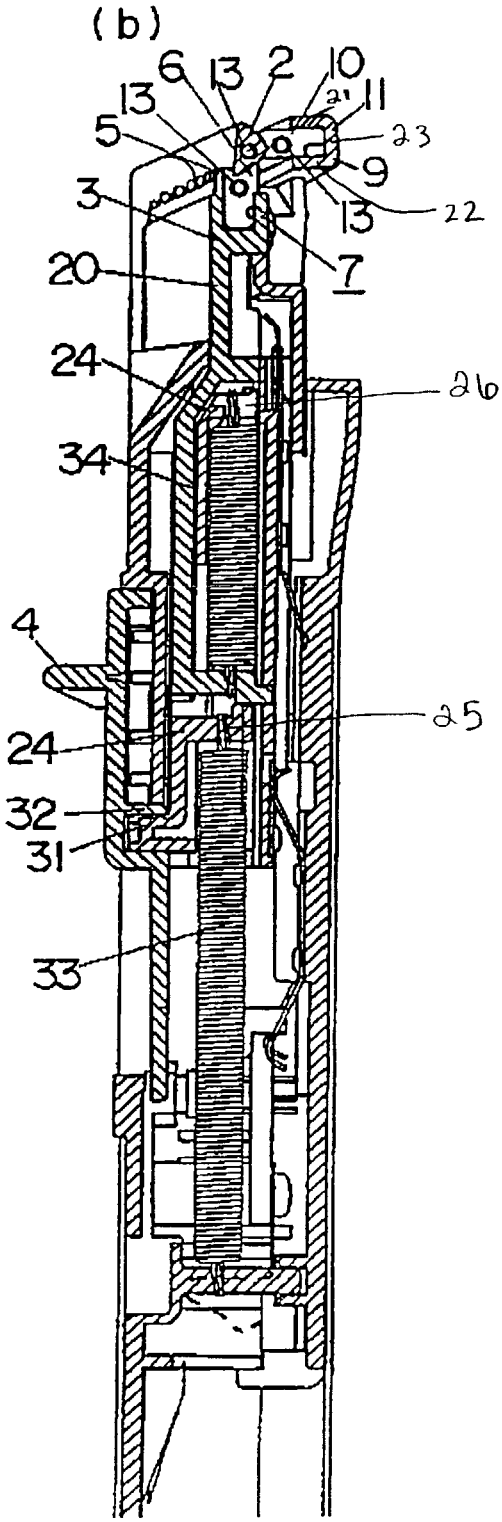

FIGS. 3A and 3B show a front view and a side cross sectional view respectively of the eyelash curler in a curling position after operation of the operating handle 4 in accordance with an embodiment of the present invention. As seen in FIG. 3B, the operating handle 4 is slid upwardly to the uppermost position within its track in the curler body 14, and the first spring 33 and second spring 34 are stretched to a tension position. As also seen in this figure, in the curling position, the combing member 5 is moved adjacent to the positioning frame 2, and the concave surfaces of the elastic pressing members 6 and 10 are in contact with the convex surfaces of the positioning frame 2. Thus, operation of the eyelash curler by sliding the operating handle 4 upward causes the pressing frame 3 and the auxiliary pressing frame 9 to move upward into contact with the positioning frame 2. More specifically, sliding the operating handle 4 upward from the initial position shown in FIGS. 2A and 2B to the curling position in FIGS. 3A and 3B causes two stages of movement within the curler body.

In the first stage of movement, sliding the handle 4 upward slides the slide knob 24 upward within the curler body 14. This causes the first spring 33 to stretch into a tension position as the lower hanger 25 moves relative to the curler body 14. As noted above, the second spring 34 is also coupled to the movable piece 24 by way of the upper hanger 26. In a preferred embodiment, the force required to stretch the second spring 24 is greater than the friction force of the movable piece 20 within the curler body 14. Thus, in the first stage of movement, the second spring 34 remains unstretched and the movable piece 20 moves in unison with the operating handle 4 and slide knob 24. Moreover, as the pressing frame 3 and auxiliary pressing frame 9 are connected to the movable piece 20 and slide knob 24 respectively, the pressing frame 3 and auxiliary pressing frame 9 also move in unison toward the positioning frame 2 during the first stage of movement. After the operating handle has been slid upward for a predetermined distance, the concave surface of the elastic pressing member 6 contacts the convex surface of the positioning frame 2. This causes the pressing frame 3, the movable piece 20 and combing member 5 connected thereto to stop and ends the first stage of movement.

In the second stage of movement, only the auxiliary pressing frame 9 moves toward the positioning frame 2. As seen in FIG. 2B, in the initial position, the pressing frame 3 is positioned above the auxiliary pressing frame 9. After the first stage of movement causes the pressing member 3 to press against the positioning member 2 and stop, further sliding of the operating handle 4 causes a second stage of movement wherein the auxiliary pressing frame 9 moves past the pressing frame 3 in a vertical direction. Specifically, in the second stage of movement, handle 4 is slid further upward causing upper hanger 26 of the move upward relative to the now stationary movable piece 20. This allows the second spring 34 to stretch into a tension position and causes the concave surface of the elastic pressing member 10 to contact the rightward facing convex surface of the positioning frame as shown in FIG. 3B. With the first and second springs in a tension position, release of the operating handle 4 causes the eyelash curler to automatically return to the initial position shown in FIG. 2B.

Figure 4:
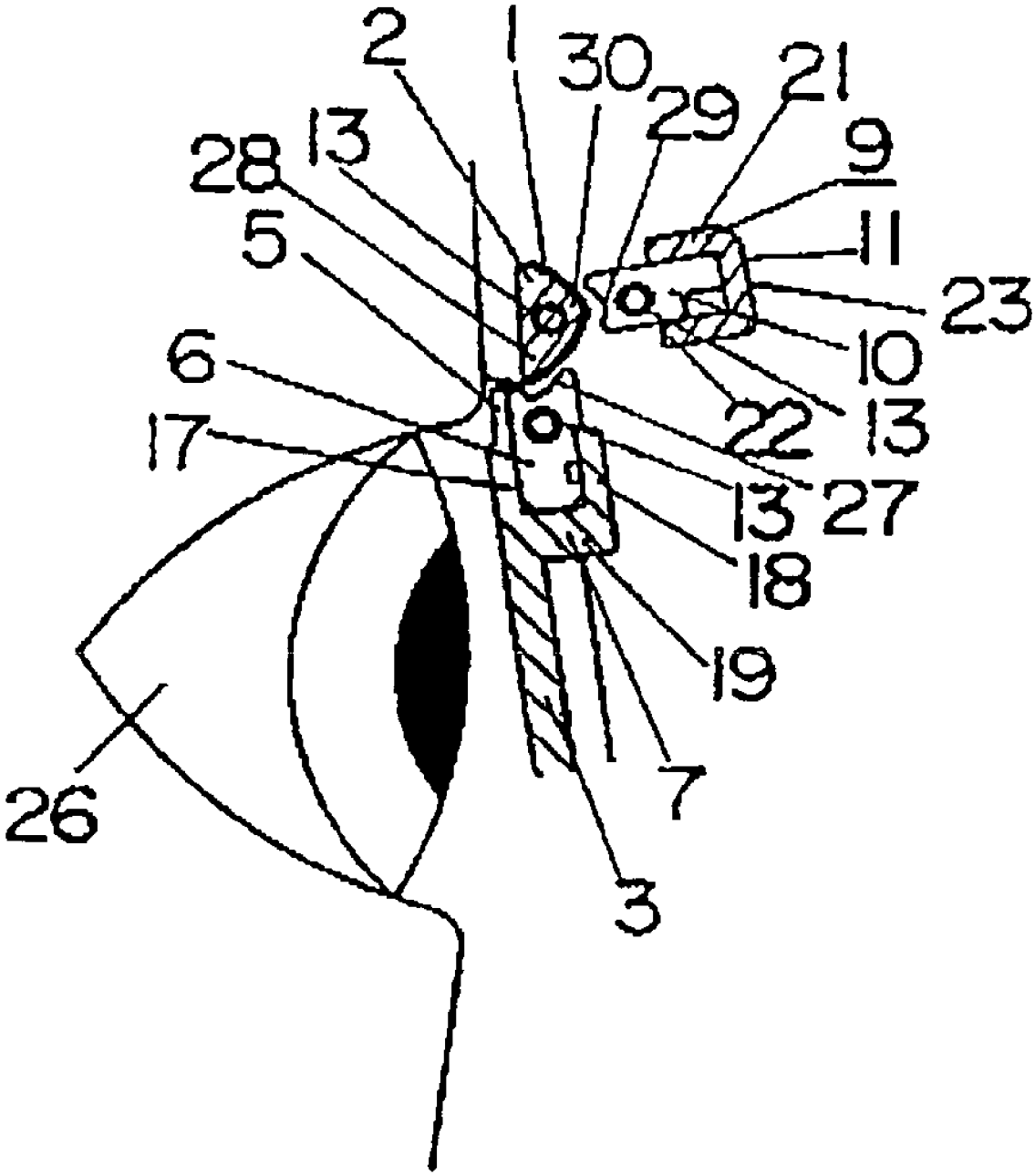
FIG. 4 is an illustration showing the position of the pressing frame, combing member and auxiliary pressing frame relative to eyelashes, in accordance with an embodiment of the present invention.

FIG. 4 is an illustration showing the position of the pressing frame 3, combing member 5 and auxiliary pressing frame 9 relative to eyelashes 1 in accordance with an embodiment of the present invention. In operation, the eyelash curler is pressed against the eyelid of the eye 26 with the eyelashes 1 inserted into the window 25 of the eyelash curler. In the first stage of movement, the pressing frame 3 and the comb member 5 attached thereto move into contact with a lash line region of the lashes 1 before the elastic pressing member 6 presses the lashes 1 against the positioning frame 2. The lash line region of the lashes is a region of the lashes closer to the line of the eyelid, where the lashes are attached, than to the end of the lashes away from the eyelid. Because the combing member 5 protrudes above the elastic pressing member 6, the juts 12 of the combing member comb through the lashes 1 causing the naturally large bundles of the lashes to be divided into several small bundles. Subsequently, the concave surface 27 of the elastic pressing member 6 presses the lash line region of the divided lashes into the downward facing convex surface of the positioning frame 2 causing the lash line region to be curled. In a preferred embodiment, the heating units 13 apply heat to the lash line region of the lashes causing a more effective and long-lasting curl.

After the lash line region of the lashes 1 are fixed between the pressing frame 6 and the positioning frame 2, the second stage of movement causes the auxiliary pressing frame 9 to contact a middle region of the lashes before the elastic pressing member 10 presses the lashes 1 against the positioning frame 2. The middle region of the lashes is the region of the lashes between a point where the elastic pressing member 6 of the pressing frame 3 contacts the lashes, and the end of the lashes away from the eye. The concave surface 29 of the elastic pressing member 10 pushing the middle region of the lashes 1 into the rearward facing convex surface of the positioning frame 2 causes the middle region of the lashes 1 to be curled. In a preferred embodiment, the heating units 13 apply heat to the middle region of the lashes 1 causing a more effective and long-lasting curl.

Thus, the eyelash curler according to the embodiment of FIG. 4 divides the eyelashes into several bundles prior to curling the lashes so that curling of the lashes is more effective and long-lasting. In addition, two-stage curling of the lashes allows a lash line region and a middle region of the lashes to be curled, also allowing a more effective and long-lasting curl of the lashes. Moreover, the two-stage curling of the lashes allows the lash line region of the lashes to be securely fixed prior to curling of the middle region of the lashes. This reduces re-bunching of the lashes when curling of the middle region of the lashes takes place. Also, a simple sliding action of the operating handle may cause a combination of combing and two-stage curling of the lashes making the curled lash long lasting and beautiful.

FIGS. 5A–5D show the details of the combing member 5 and juts 12 in relation to the pressing frame 3. As seen in FIGS. 5A and 5B, the combing member 5 is connected to the front panel 17 so that juts 12 extend slightly above the elastic pressing member 6 to ensure combing action of the lashes prior to contact of the pressing member 6 against the positioning frame 2. In a preferred embodiment, the juts 12 of the combing member 5 are about 0.5 mm in width and about 1 mm in height while being spaced approximately 1 mm from each other as shown in FIG. 5C. As would be understood by one of ordinary skill in the art, however, the projecting members may be sized and spaced differently depending on manufacturing considerations and the nature of the curl desired by the user of the eyelash curler. For example, the dimensions of the combing member 5 may be changed to achieve different size bunches of the eyelashes, which would cause a different look achieved by the curler. Moreover, while the juts 12 in FIGS. 5A–5C are shown to have a rounded contour, the projections may have a tooth like profile as shown in FIG. 5D. Thus, one of ordinary skill in the art would understand that various shapes and spacings of the juts 12 may be found to achieve different looking lashes without deviating from the inventive concepts of the disclosed invention.

Figure 6:
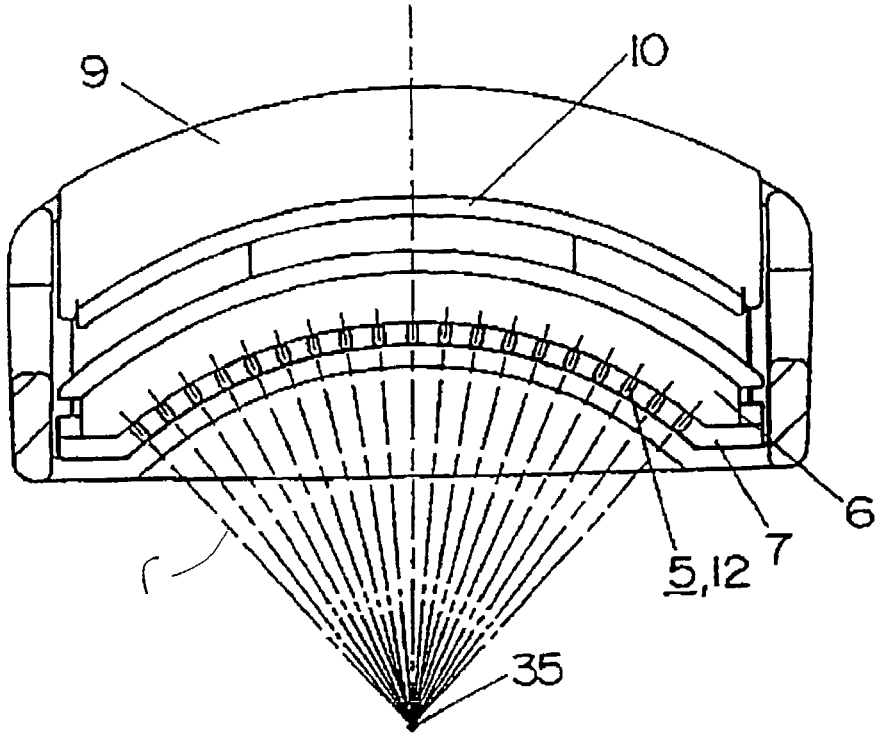
FIG. 6 is a cross sectional top view showing a detailed configuration of the curling member of an eyelash curler in accordance with an embodiment of the present invention.

FIG. 6 is a cross sectional top view showing a detailed configuration of the curling member of an eyelash curler in accordance with an embodiment of the present invention. As seen in this figure, the curling member 5 is mounted at the box shaped part 7 of the pressing frame 3 such that the juts 12 of the combing member 5 are circumferentially arranged about a center point 35 of the eyeball 26 when the user uses the eyelash curler. The juts 12 are individually mounted in alignment with radial lines "r" projecting outward from the center point 35. As also seen in FIG. 6, the juts 12 may be mounted at equal angular intervals along the curved contour of the combing member 5.

Figure 7:
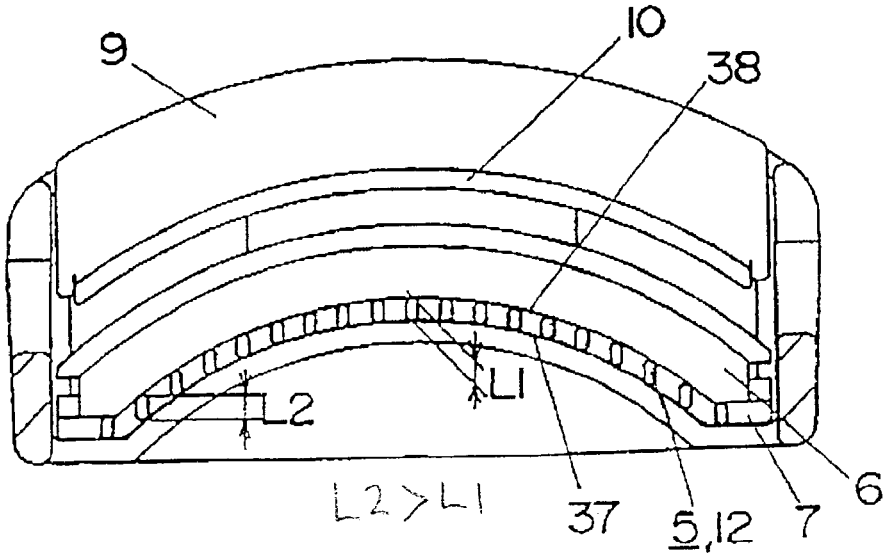
FIG. 7 is a cross sectional top view showing a detailed configuration of the combing member of an eyelash curler in accordance with another embodiment of the present invention.

FIG. 7 is a cross sectional top view showing a detailed configuration of the combing member of an eyelash curler in accordance with another embodiment of the present invention. As seen in this figure, the curling member 5 is mounted at the box shaped part 7 such that the juts 12 are circumferentially arranged. Moreover, the juts 12 are equally spaced from one another. However, in the embodiment of FIG. 7, the juts 12 are positioned parallel to one another in a front to back direction. More specifically, the juts 12 of the combing member 5 are bounded by an inner circumference edge 37 and an outer circumference edge 38 each having the center point 35. Each of the juts 12 is mounted from the inner circumference edge 37 to the outer circumference edge 38 and is parallel to an adjacent jut 12. With this configuration, the length of each jut 12 in a forward to backward direction becomes larger as the jut is positioned away from a center of the combing member 5. That is, the length L2 is larger than the length L1 as seen in FIG. 7. Thus, when using the eyelash curler of FIG. 7, outside lashes at the tail of an eyelash group are combed by longer juts 12 placing more emphasis on these lashes making the tails of the eye area look beautiful.

Figure 8:
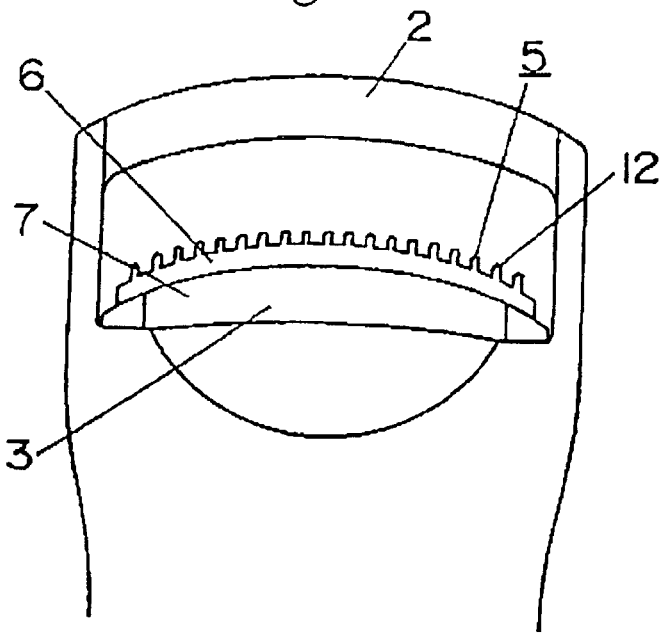
FIG. 8 shows an eyelash curler having a combing member positioned on the elastic pressing member of the pressing frame in accordance with an embodiment of the present invention.

While the embodiments discussed above describe the combing member positioned on the front panel 17 of the box shaped part 7 of the pressing frame 3, the combing member may be positioned on different portions of the eyelash curler. FIG. 8 shows an eyelash curler having a combing member positioned on the elastic pressing member of the pressing frame in accordance with an embodiment of the present invention. As seen in this figure, the juts 12 are placed directly on the surface of the elastic pressing member 6. The juts 12 are made of an elastic material, which may be the same or different from the material of the elastic pressing member 6. Moreover, the juts 12 may be sized and arranged according to any one, or any combination, of the configurations shown in FIG. 5-7 described above.

Figure 9:
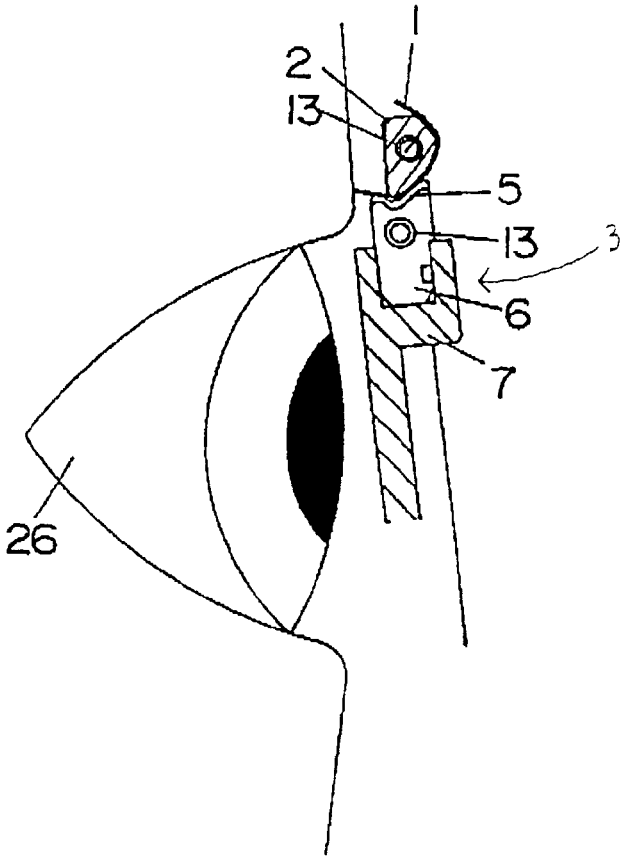
FIG. 9 shows a curling operation of an eyelash curler having a combing member positioned on an elastic pressing member of the pressing frame in accordance with an embodiment of the present invention.

FIG. 9 shows a curling operation of an eyelash curler having a combing member positioned on an elastic pressing member of the pressing frame in accordance with an embodiment of the present invention. As seen in this figure, when the pressing frame 3 is moved toward the positioning frame 2, the combing member 5 first combs the lash line region of the lashes 1 to divide the naturally large bundle of lashes into several small bundles. The elastic pressing member 6 then presses the divided lashes against the positioning frame 2 causing an effective and long-lasting curl to the lash line region of the lashes. Actual pinching of the lashes 1 between the elastic pressing member 6 and the positioning frame 2 is enabled by deforming the elastic juts 12 when the juts are pressed against the positioning frame 2.

Figure 10:
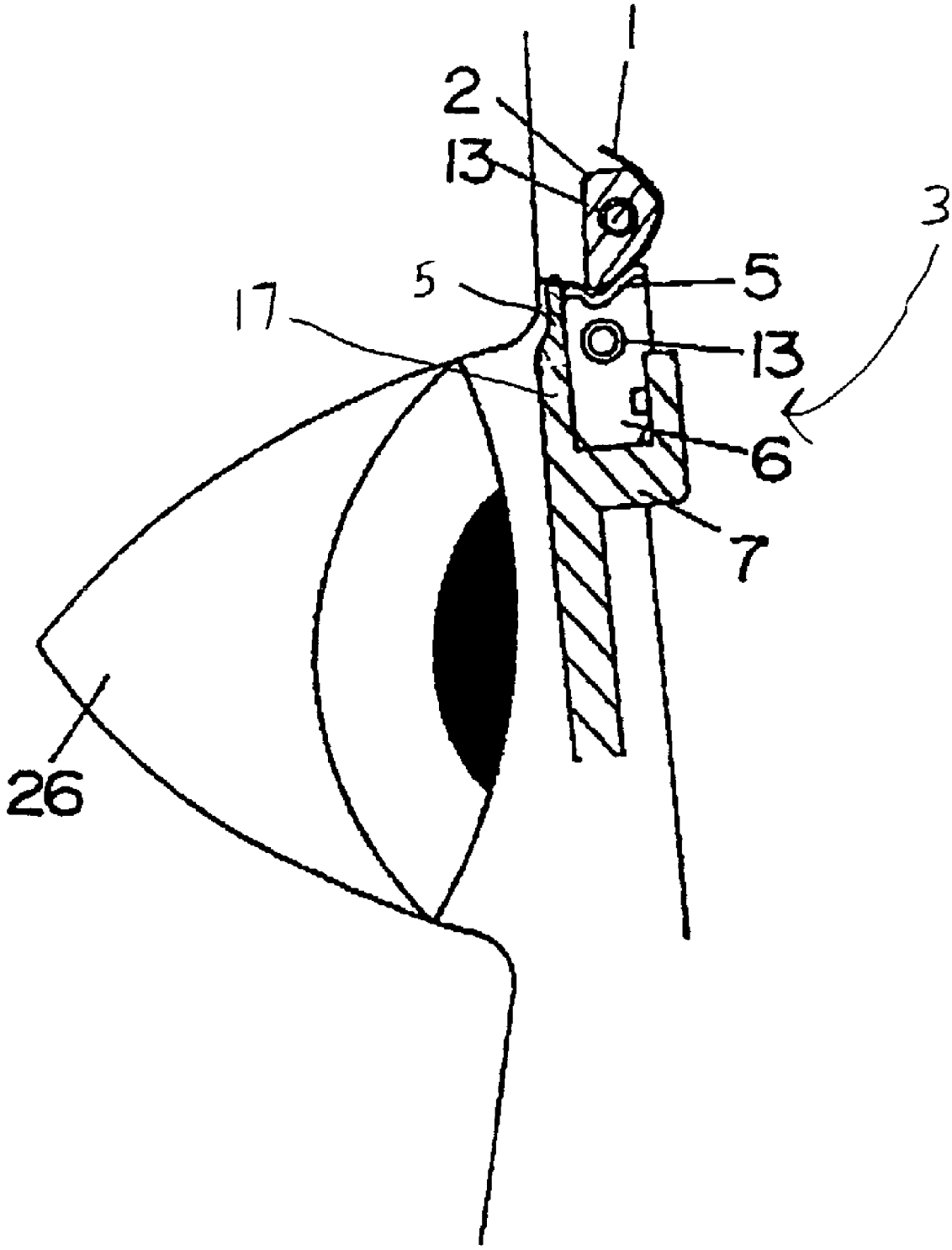
FIG. 10 shows an eyelash curler having a combing member positioned on both the front panel and the elastic pressing member of the pressing frame in accordance with an embodiment of the present invention.

Another embodiment of the eyelash curler may combine the features of the embodiment shown in FIGS. 2–4 with the features of the embodiment shown in FIGS. 8 and 9. FIG. 10 shows an eyelash curler having a combing member positioned on both the front panel 17 and the elastic pressing member 6 of the pressing frame 3 in accordance with an embodiment of the present invention. As seen in this figure, when the pressing frame 3 is moved toward the positioning frame 2, the combing members 5 first comb the lash line region of the lashes 1 to divide the naturally large bundle of lashes into several small bundles. The elastic pressing member 6 then presses the divided lashes against the positioning frame 2 causing an effective and long-lasting curl to the lash line region of the lashes 1.

Figure 11:
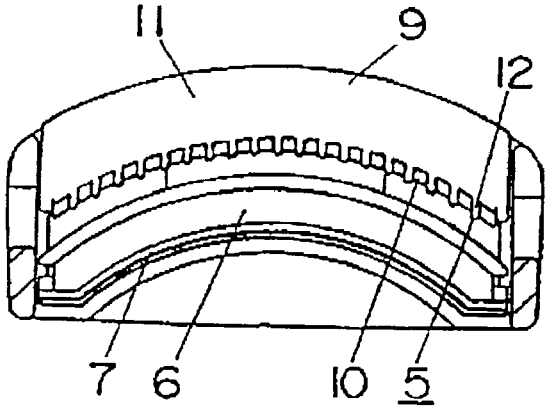
FIG. 11 shows an eyelash curler having a combining member positioned on the box shaped part of the auxiliary pressing frame in accordance with an embodiment of the present invention.

The combing member may also be positioned on the auxiliary pressing frame 9. FIG. 11 shows an eyelash curler having a combining member positioned on the box shaped part 11 of the auxiliary pressing frame 9 in accordance with an embodiment of the present invention. As seen in this figure, the juts 12 are placed on the box shaped part 11 to protrude beyond the elastic pressing member 10. The juts 12 may be made of the same material or different material from that used for the box shaped part 11. Moreover, the juts 12 may be sized and arranged according to any one, or any combination, of the configurations shown in FIGS. 5–7 described above.

Figure 12:
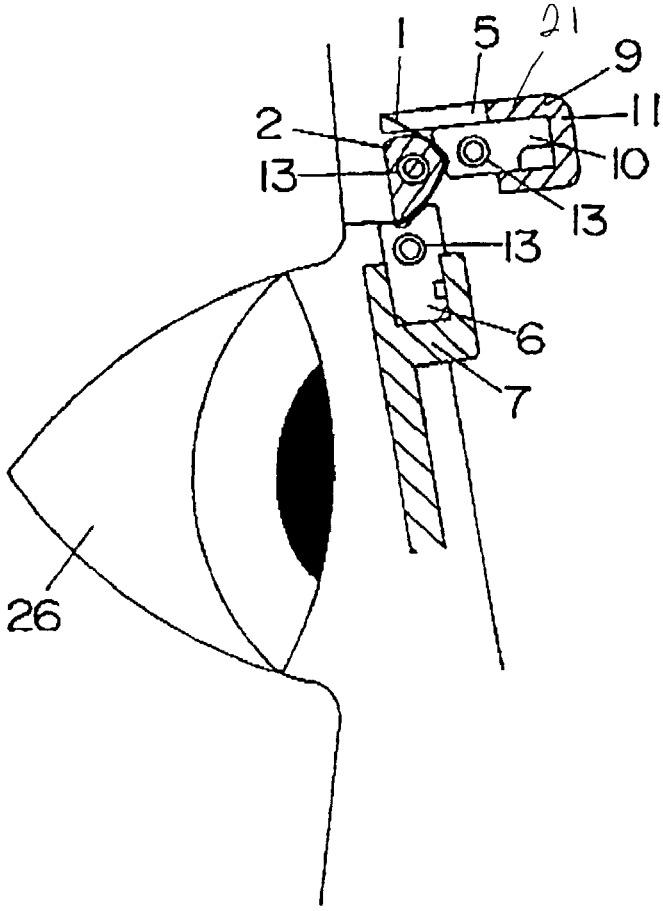
FIG. 12 shows a curling operation of an eyelash curler having a combing member positioned on the box shaped part of the auxiliary pressing frame in accordance with an embodiment of the present invention.

FIG. 12 shows a curling operation of an eyelash curler having a combing member positioned on the box shaped part of the auxiliary pressing frame in accordance with an embodiment of the present invention. As seen in this figure, when the auxiliary pressing frame 9 is moved toward the positioning frame 2, the combing member 5 first combs the middle region of the lashes 1 to divide the naturally large bundle of lashes into several small bundles. The elastic pressing member 10 then presses the divided lashes against the positioning frame 2 causing an effective and long-lasting curl to the middle region of the lashes.

Figure 13:
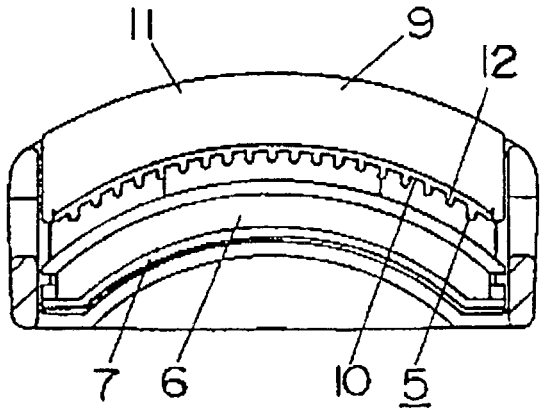
FIG. 13 shows an eyelash curler having a combing member positioned on the elastic pressing member of the auxiliary pressing frame in accordance with an embodiment of the present invention.

FIG. 13 shows an eyelash curler having a combing member positioned on the elastic pressing member of the auxiliary pressing frame in accordance with an embodiment of the present invention. As seen in this figure, the juts 12 are placed directly on the surface of the elastic pressing member 6. The juts 12 are made of an elastic material, which may be the same or different from the material of the elastic pressing member 10. Moreover, the juts 12 may be sized and arranged according to any one, or any combination, of the configurations shown in FIGS. 5–7 described above.

Figure 14:
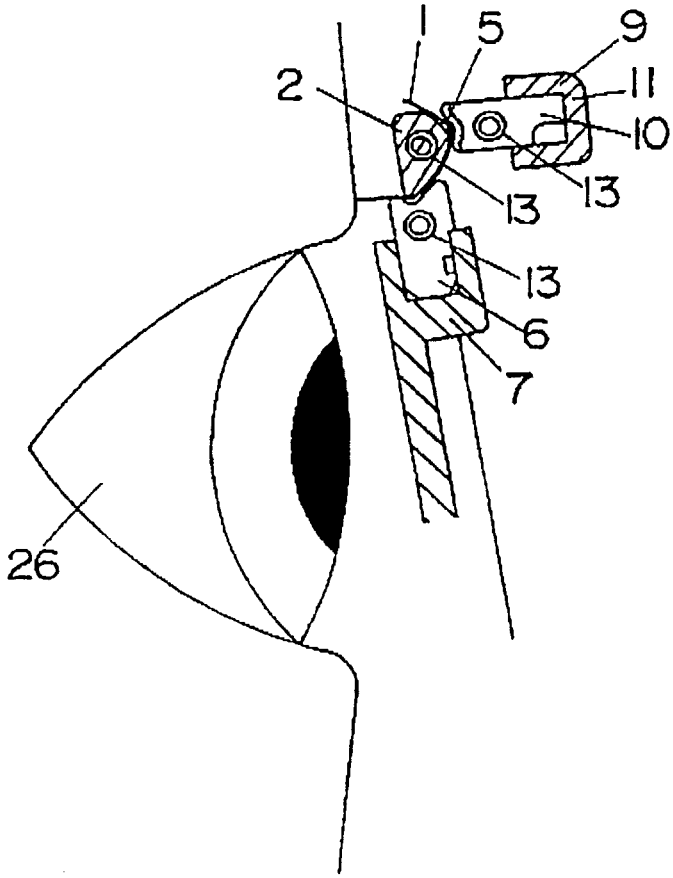
FIG. 14 shows a curling operation of an eyelash curler having a combing member positioned on an elastic pressing member of the auxiliary pressing frame in accordance with an embodiment of the present invention.

FIG. 14 shows a curling operation of an eyelash curler having a combing member positioned on an elastic pressing member of the auxiliary pressing frame in accordance with an embodiment of the present invention. As seen in this figure, when the auxiliary pressing frame 9 is moved toward the positioning frame 2, the combing member 5 first combs the middle region of the lashes 1 to divide the naturally large bundle of lashes into several small bundles. The elastic pressing member 10 then presses the divided lashes against the positioning frame 2 causing an effective and long-lasting curl to the middle region of the lashes. Actual pinching of the lashes 1 between the elastic pressing member 10 and the positioning frame 2 is enabled by deforming the elastic juts 12 when the juts are pressed against the positioning frame 2.

Figure 15:
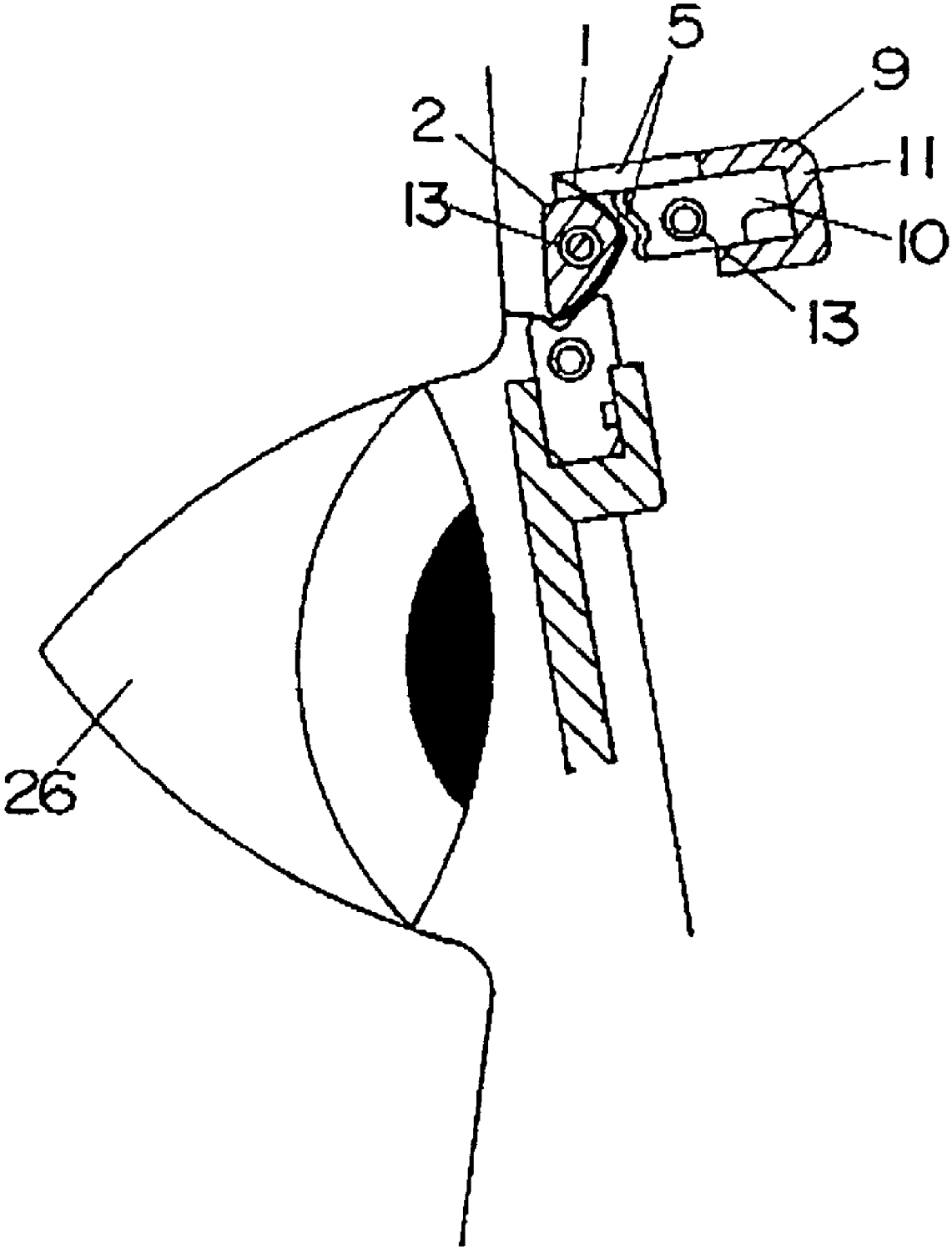
FIG. 15 shows a curling operation of an eyelash curler having combing members positioned on both the box shaped part and the elastic pressing member of the auxiliary pressing frame in accordance with an embodiment of the present invention.

Another embodiment of the eyelash curler combines the features of the embodiment shown in FIGS. 11 and 12 with the features of the embodiment shown in FIGS. 13 and 14. FIG. 15 shows a curling operation of an eyelash curler having combing members positioned on both the box shaped part 11 and the elastic pressing member 10 of the auxiliary pressing frame 9 in accordance with an embodiment of the present invention. As seen in this figure, when the auxiliary pressing frame 9 is moved toward the positioning frame 2, the combing members 5 first comb the middle region of the lashes 1 to divide the naturally large bundle of lashes into several small bundles. The elastic pressing member 10 then presses the divided lashes against the positioning frame 2 causing an effective and long-lasting curl to the lash line region of the lashes.

Figure 16:
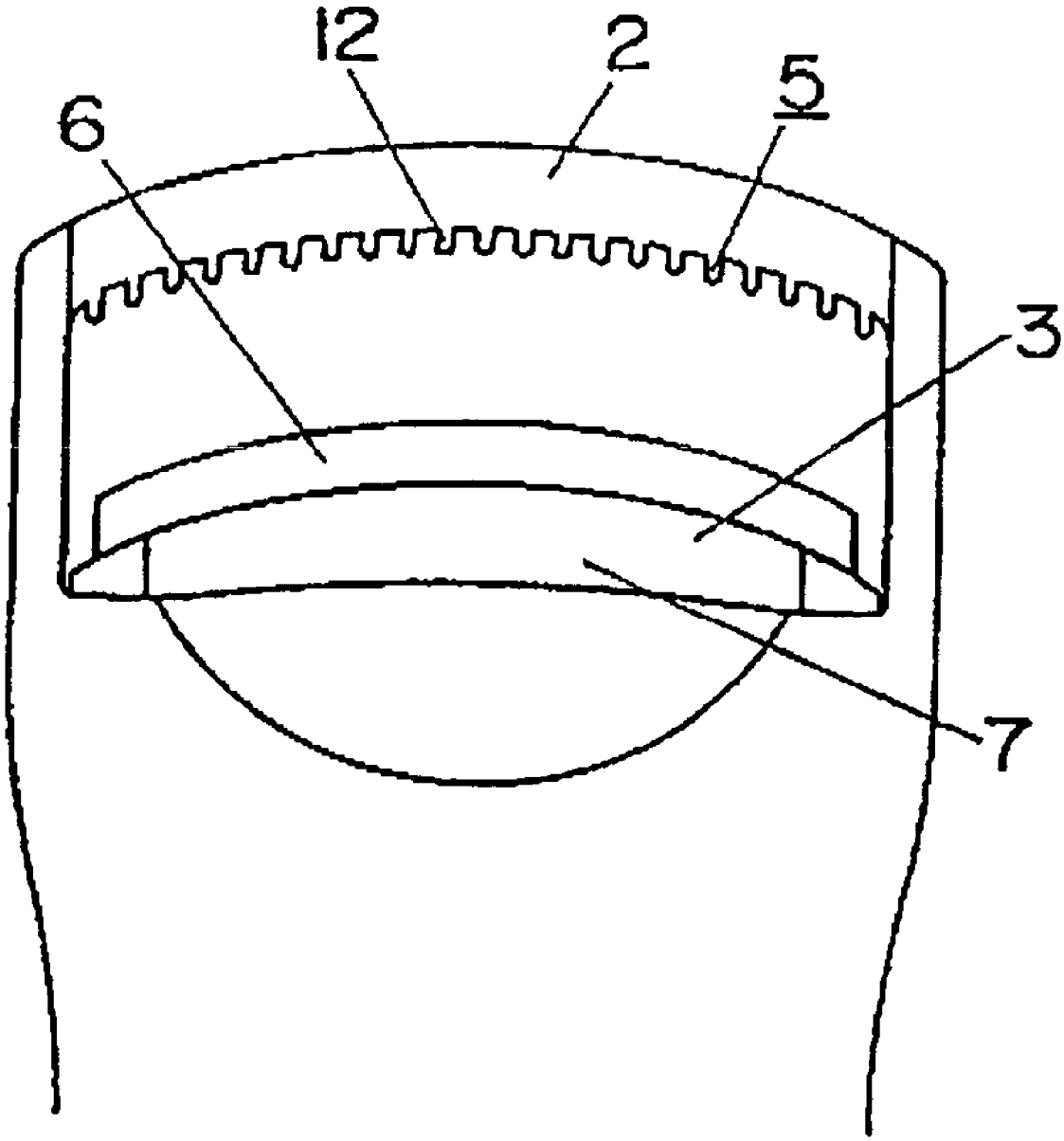
FIG. 16 is a partial front view of an eyelash curler having a combing member positioned on a positioning member in accordance with another embodiment of the present invention.

FIG. 16 is a partial front view of an eyelash curler in accordance with another embodiment of the present invention. As seen in this figure, the combing member 5 is mounted on the positioning frame 2 of the eyelash curler. Juts 12 of the combing member 5 protrude downward toward the pressing member 3. In operation, as the elastic pressing member 6 of the pressing frame 3 pushes the eyelashes against the positioning frame 2, the combing member 5 first combs the lash line region of the lashes 1 to divide the naturally large bundles of lashes into several small bundles. The elastic pressing member then presses the divided lashes against the positioning frame 2 causing an effective and long-lasting curl to the lash line region of the lashes 1. In the embodiment of the eyelash curler shown in FIG. 16, the juts 12 may be made of an elastic or non-elastic material. Therefore, actual pinching of the lashes 1 between the elastic pressing member 6 and the position frame 2 is enabled by deforming the elastic pressing member 6 and/or the juts 12. Alternatively, the juts 12 may be offset on the positioning frame 2 so that the elastic pressing member 6 avoids direct contact with the juts.

Obviously, numerous modifications and variations of the present invention are possible in light of the above teachings. It is therefore to be understood that within the scope of the appended claims, the invention may be practiced otherwise than as specifically described herein. For example, the various different positions of the combing member 5 on the eyelash curler may be combined to provide an eyelash curler having multiple combing members for dividing the eyelashes into several small bunches.

The invention claimed is:

1. A device for curling eyelashes, comprising:

a positioning frame;

a pressing frame mounted opposing said positioning frame and configured to move relative to said positioning frame, said pressing frame having a rigid part and an elastic pressing member, said rigid part having a box shaped recess, said elastic pressing member retained within said box shaped recess and having an elastic surface;

an operating handle configured to move said elastic surface of said pressing frame in and out of contact with said positioning frame and to thereby curl eyelashes positioned between the positioning frame and elastic surface;

a first combing member mounted on said rigid part of said pressing frame and configured to divide said eyelashes into multiple bunches prior to and during an entire period of curling the eyelashes; and a second combing member mounted on said elastic surface of said pressing frame.

2. The device of claim 1, wherein said pressing frame is a pressing frame configured to curl a lash line region of said eyelashes.

3. The device of claim 1, wherein:

said positioning frame comprises a convex surface, said elastic surface comprises a concave surface substantially contouring said convex surface, and operation of said operating handle mates said concave surface with said convex surface causing curling of said eyelash along the mating surfaces.

4. The device of claim 1, wherein said first combing member comprises a plurality of juts positioned along the combing member.

5. The device of claim 4, wherein said plurality of juts are positioned parallel to one another on said first combing member.

6. The device of claim 4, wherein said plurality of juts are positioned parallel to radial lines extending outward from a center point corresponding to a center point of an eyeball of a user of the eyelash curler.

7. The device of claim 4, wherein each of said juts has a contoured surface.

8. The device of claim 4, wherein each of said juts has a sawtooth surface.

9. The device of claim 1, wherein at least one of said positioning frame and said pressing frame comprises a heating unit.

10. The device of claim 9, wherein said heating unit comprises a coiled wire.

11. A device for curling eyelashes, comprising:

a positioning frame;

a pressing frame mounted opposing said positioning frame and configured to move relative to said positioning frame and curl a lash line region of said eyelashes, said pressing frame having an elastic surface;

an operating handle configured to move said elastic surface of said pressing frame in and out of contact with said positioning frame and to thereby curl eyelashes positioned between the positioning frame and elastic surface;

a combing member configured to divide said eyelashes into multiple bunches prior to and during an entire period of curling the eyelashes; and an auxiliary pressing frame mounted opposing said positioning frame and configured to move relative to said positioning frame, said auxiliary pressing frame having a second elastic surface, wherein said operating handle is further configured to move said second elastic surface in and out of contact with said positioning frame to thereby curl a middle region of said eyelashes positioned between the positioning frame and second elastic surface.

12. The device of claim 11, wherein said pressing frame comprises:

a rigid part having a box shaped recess; and an elastic pressing member retained within said box shaped recess and having said elastic surface, wherein said combing member is mounted on said rigid part and configured to divide said eyelashes into multiple bunches prior to curling the lash line region of said eyelashes.

13. The device of claim 11, wherein said combing member is mounted on said elastic surface of said pressing frame and configured to divide said eyelashes into multiple bunches prior to curling the lash line region of said eyelashes.

14. The device of claim 11, wherein said auxiliary pressing frame comprises:

a rigid part having a box shaped recess; and an elastic pressing member retained within said box shaped recess and having said second elastic surface, wherein said combing member is mounted on said rigid part and configured to divide said eyelashes into multiple bunches prior to curling the middle region of said eyelashes.

15. The device of claim 11, wherein said combing member is mounted on said second elastic surface of said auxiliary pressing frame and configured to divide said eyelashes into multiple bunches prior to curling the middle region of said eyelashes.

16. The device of claim 11, wherein said combing member is mounted on said pressing frame and configured to divide said eyelashes into multiple bunches prior to curling the lash line region of said eyelashes, said device further comprising a second combing member mounted on said auxiliary pressing frame and configured to divide said eyelashes into multiple bunches prior to curling the middle region of said eyelashes.

17. The device of claim 11, wherein said pressing frame and said auxiliary pressing frame are configured such that operation of said operating handle causes said elastic surface of the pressing frame to contact said positioning frame before said second elastic surface of the auxiliary pressing frame contacts said positioning frame.

18. The device of claim 11, wherein at least one of said positioning frame, said pressing frame and said auxiliary pressing frame comprises a heating unit.

19. The device of claim 18, wherein said heating unit comprises a coiled wire.

20. The device of claim 11, wherein:

said positioning frame comprises a convex surface;

said elastic surface comprises a concave surface substantially contouring said convex surface; and operation of said operating handle mates said concave surface with said convex surface causing curling of said eyelash along the mating surfaces.

21. The device of claim 11, wherein said combing member comprises a plurality of juts positioned along the combing member.

22. The device of claim 21, wherein said plurality of juts are positioned parallel to one another on said combing member.

23. The device of claim 21, wherein said plurality of juts are positioned parallel to radial lines extending outward from a center point corresponding to a center point of an eyeball of a user of the eyelash curler.

24. The device of claim 21, wherein each of said juts has a contoured surface.

25. The device of claim 21, wherein each of said juts has a sawtooth surface.

26. The device of claim 11, wherein at least one of said positioning frame and said pressing frame comprises a heating unit.

27. The device of claim 26, wherein said heating unit comprises a coiled wire.

28. A method of curling eyelashes using an eyelash curler having a rigid positioning member with a combing member and an elastic pressing member opposed to the positioning member, the method comprising:

inserting the eyelashes into a space between the positioning member and the elastic pressing member;

moving the combing member of the curling device through the eyelashes to divide the eyelashes into multiple bunches before curling the eyelashes;

pressing the elastic pressing member against the rigid positioning member with the eyelashes interposed therebetween such that the multiple bunches of eyelashes are curled; and maintaining the combing member during an entire period of curling the eyelashes in a position in which the combing member divides the eyelashes into multiple bunches.

29. The method of claim 28, wherein said pressing comprises pressing the elastic pressing member against a first position of the rigid positioning member with a first region of the eyelashes interposed therebetween such that the first region of the eyelashes is curled, said method further comprising:

pressing another elastic pressing member against a second position of the rigid positioning member with a second region of the eyelashes interposed therebetween such that the second region of the eyelashes is curled, wherein pressing of at least one of said elastic pressing members occurs before dividing the eyelashes into multiple bunches.

30. The method of claim 29, further comprising:

moving another combing member of the curling device through the eyelashes to further divide the eyelashes into multiple bunches, wherein said dividing the eyelashes occurs prior to curling the first region of the eyelashes and said further dividing the eyelashes occurs prior to combing the second region of the eyelashes.

31. The method of claim 29, wherein said curling the first region of the eyelashes comprises curling a lash line region of the eyelashes, and said curling the second region of the eyelashes comprises curling a middle region of the eyelashes.

32. The method of claim 28, further comprising moving an operation handle of said curling device, wherein said moving an operation handle causes said moving and pressing steps.

33. The method of claim 28, further comprising heating at least one of said positioning member and said pressing member.

34. A device for curling eyelashes, comprising:

a positioning member;

a pressing frame mounted opposing said positioning frame and configured to move relative to said positioning frame, said pressing frame having a rigid part and an elastic pressing member, said rigid part having a box shaped recess, said elastic pressing member retained within said box shaped recess and having an elastic surface;

an operating handle configured to move said elastic surface of said pressing frame in and out of contact with said positioning frame and to thereby curl eyelashes positioned between the positioning frame and elastic surface;

first combing means for dividing the eyelashes into multiple bunches prior to said positioning member and said pressing frame performing curling of the eyelashes and during an entire period of performing curling of the eyelashes, said first combing means being mounted on said rigid part of said pressing frame; and second combing means for dividing the eyelashes into multiple bunches, said second combing means being mounted on said elastic surface of said pressing frame.

35. The device of claim 34, further comprising means for heating the eyelashes.

* * * * *